US006675438B2

(12) United States Patent
Dilger et al.

(10) Patent No.: US 6,675,438 B2
(45) Date of Patent: Jan. 13, 2004

(54) VACUUM-CLEANER FLOOR HEAD

(75) Inventors: Horst Dilger, Morsbach (DE); Hans-Joachim Steudtner, Reichshof (DE); Dieter Kaffenberger, Wiehl (DE)

(73) Assignee: Wessel-Werke GmbH, Reichshof-Wilbergerhutte (DE)

( * ) Notice: Subject to any disclaimer, the term of this patent is extended or adjusted under 35 U.S.C. 154(b) by 0 days.

(21) Appl. No.: 10/039,177

(22) Filed: Jan. 2, 2002

(65) Prior Publication Data

US 2002/0083552 A1 Jul. 4, 2002

Related U.S. Application Data

(63) Continuation-in-part of application No. 09/504,684, filed on Feb. 15, 2000, now abandoned.

(30) Foreign Application Priority Data

Feb. 19, 1999 (DE) ..... 299 03 009 U

(51) Int. Cl.[7] ..... A47L 9/06
(52) U.S. Cl. ..... 15/420; 15/373; 15/401
(58) Field of Search ..... 15/401, 402, 415.1, 15/420, 373, 245

(56) References Cited

U.S. PATENT DOCUMENTS

| | | | | | |
|---|---|---|---|---|---|
| 2,581,002 | A | * | 1/1952 | Creswell | 15/420 |
| 2,860,367 | A | * | 11/1958 | Kolenda et al. | 15/420 |
| 2,893,046 | A | * | 7/1959 | Thompson | 15/401 |
| 3,072,951 | A | * | 1/1963 | Kelnhofer | 15/401 |
| 3,107,387 | A | * | 10/1963 | Katt | 15/401 |
| 3,719,966 | A | * | 3/1973 | Lamont | 15/420 |
| 5,101,534 | A | * | 4/1992 | Watanabe et al. | 15/420 |
| 5,123,141 | A | * | 6/1992 | Erickson et al. | 15/373 |
| 5,349,722 | A | * | 9/1994 | Chayer | 15/401 |
| 5,539,953 | A | | 7/1996 | Kurz | 15/367 |
| 5,839,158 | A | | 11/1998 | Schupp et al. | 15/350 |
| 5,850,669 | A | | 12/1998 | Schupp et al. | 15/366 |
| 6,434,786 | B1 | * | 8/2002 | Roberts | 15/420 |

FOREIGN PATENT DOCUMENTS

| | | | |
|---|---|---|---|
| DE | 3801757 | | 7/1989 |
| DE | 196 28 070 | * | 1/1998 |
| EP | 0552652 | | 7/1993 |
| EP | 0747001 | | 12/1996 |
| EP | 0788758 | | 8/1997 |
| FR | 2695023 | | 3/1994 |

* cited by examiner

*Primary Examiner*—Theresa T. Snider
(74) *Attorney, Agent, or Firm*—Herbert Dubno; Andrew Wilford

(57) ABSTRACT

A vacuum-cleaner floor head has a base plate formed with an elongated mouth through which air is aspirated, a frame vertically displaceable between a lower position and an upper position, and a plastic tube carried on the frame, engaging a floor underneath the head in the lower position, and clear of the floor in the upper position. The plastic tube is elastomerically compressible, surrounds the mouth, and is sufficiently firm to support the head off the floor without substantial deformation during normal back and forth stroking of the head on the floor in the lower position of the frame. The plastic tube has at least to a front side of the mouth a profiled lower surface formed with a plurality of alternating ridges and hollows so that in the lower position the ridges engage the floor and air can be aspirated through the hollows between the floor and the strip.

2 Claims, 1 Drawing Sheet

VACUUM-CLEANER FLOOR HEAD

CROSS REFERENCE TO RELATED APPLICATION

This application is a continuation-in-part of application Ser. No. 09/504,684 filed Feb. 15, 2000 (now abandoned).

FIELD OF THE INVENTION

The present invention relates to a head for a vacuum cleaner. More particularly this invention concerns a floor head for dry vacuuming of a smooth or carpeted, not wet, floor.

BACKGROUND OF THE INVENTION

A typical vacuum floor head has a body attached to the intake end of a suction tube and formed with a downwardly open horizontal elongated mouth. The head moves along the floor perpendicular to the mouth and particles are aspirated up through the mouth into the tube.

A seal strip is carried on a vertically displaceable frame surrounding the mouth and can project downward through slots flanking the mouth to engage the floor in front of and normally also behind and occasionally even to the sides of the mouth to concentrate the vacuum. Thus when the frame is lowered the strip extends through the slot to engage the floor and is elastically deformed to close off the gap between the bottom surface of the head and the floor so that the suction is concentrated at the zone where the strip engages the floor. The strip is lowered when the head is used for cleaning a smooth floor. A carpeted floor is cleaned with the frame in the upper position and the bottom surface of the head riding directly on the carpet.

In the standard system the strip is made as a brush comprised of a row of vertical bristles. When new, such a structure is extremely effective as the bristles can deflect around an obstruction but still form a fairly effective flow-concentrating partition, while at the same time the bristles loosen material stuck to a smooth floor or raise the nap. With time, however the bristles normally get fouled and stuck together. Particles that can scratch a floor can become permanently lodged between the bristles. Furthermore if the head is put away with the bristles projecting, they can get permanently bent so that they no longer form a good seal. Finally if the head is rocked the strip is pulled up off the floor and creates a leak that reduces vacuuming effect.

German patent document 196 28 070 of Horst Dilger et al filed Jul. 12, 1996 and published Jan. 15, 1998 discloses a vacuum head having four rollers supporting the head and thin elastic floor-engaging lips. These lips act as wipers when bent in one direction and stiffen and act as scrapers when moved in the opposite direction. The flexible lips cannot carry the weight of the head to maintain a predetermined spacing between the lower surface of the head and the floor.

OBJECTS OF THE INVENTION

It is therefore an object of the present invention to provide an improved vacuum-cleaner floor head.

Another object is the provision of such an improved vacuum-cleaner floor head which overcomes the above-given disadvantages, that is whose seal strip has a long service life, will not pick up particles, and is of simple and inexpensive construction.

SUMMARY OF THE INVENTION

A vacuum-cleaner floor head for dry vacuuming of a smooth floor has according to the invention a base plate formed with an elongated mouth through which air is aspirated, a frame vertically displaceable between a lower position and an upper position, and a seal strip carried on the frame, engaging a floor underneath the head in the lower position, and clear of the floor in the upper position. The strip is annularly continuous and elastomerically compressible, surrounds the mouth, and is sufficiently firm to support the head off the floor without substantial deformation during normal back and forth stroking of the head on the floor in the lower position of the frame. The strip has at least to a front side of the mouth a profiled lower surface formed with a plurality of alternating ridges and hollows so that in the lower position the ridges engage the floor and air can be aspirated through the hollows between the floor and the strip.

The strip according to the invention is of a foamed plastic or can be a plastic tube. Alternately it can be formed of a needle felt. In accordance with the invention the strip is straight and extends parallel to the mouth at the front side thereof.

Thus with the system of this invention the strip itself can support the head on the floor, even when suction that pulls the head downward is applied through the mouth. In addition the strip is sufficiently firm that horizontal forces that are effective on it as the head is stroked back and forth on the floor will not be enough to allow the plate to scrape in the lower position of the frame. The use of an elastically compressible material for the seal strip allows the head to move over irregularities on the floor, for instance at a sill, and to conform to tipping of the head without losing seal and vacuuming power. At the same time the head moves smoothly and gently over a smooth floor. During normal back and forth stroking in fact the strip does not deform at all.

The vacuum head according to the invention should be used only for dry vacuuming, e.g. of a wood, linoleum, concrete, or tile floor. The frame is dropped to extend the strip and ready the head for vacuuming a dry flat floor. In order to vacuum on carpet the floor strip is retracted and the base plate of the head slides on the carpet.

When vacuuming a dry flat floor the floor strip supports the head. To this end the strip must do several things: It has to resist considerable compressive forces created not only by the weight of the vacuum head, but by the downward pressure caused by the suction inside the head. According to the invention the floor strip is sufficiently stiff that it can resist horizontal forces encountered during normal use without substantial deformation. Even so the strip is somewhat compressible so that it can accommodate minor unevenness in the floor while still forming a relatively good seal and not scratching the floor. For good dry vacuuming it is further essential that the air stream pass at high speed underneath the strip, vacuuming efficiency being proportional to speed. It is further essential that relatively coarse particles, for instance sand, not be pushed around by the vacuum, but instead be aspirated. This is possible with the ridge/hollow formation of the bottom edge of the strip which in effect creates small passages that allow such particles to pass underneath the strip and be aspirated.

It is further significant for dry flat-floor vacuuming that the strip not tend to get dirty and that particles not imbed themselves in it, as such imbedded particles can scratch. According to the invention the strip is made of a foam plastic or an elastically compressible plastic tube. It can also be made of thermoplastics such as polyvinyl chloride, polyurethane, and the like. A plastic foam, in particular, provides the necessary rigidity and deformability while particles do not readily get imbedded in its closed-cell structure which is in general quite smooth.

The strip formed as a tube also is particularly advantageous in that it has the necessary compressibility while still not tending to pick up particles. The tube can easily be constructed to be strong enough to support the head off the floor even when the head is fairly heavy and the suction applied through it is considerable.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
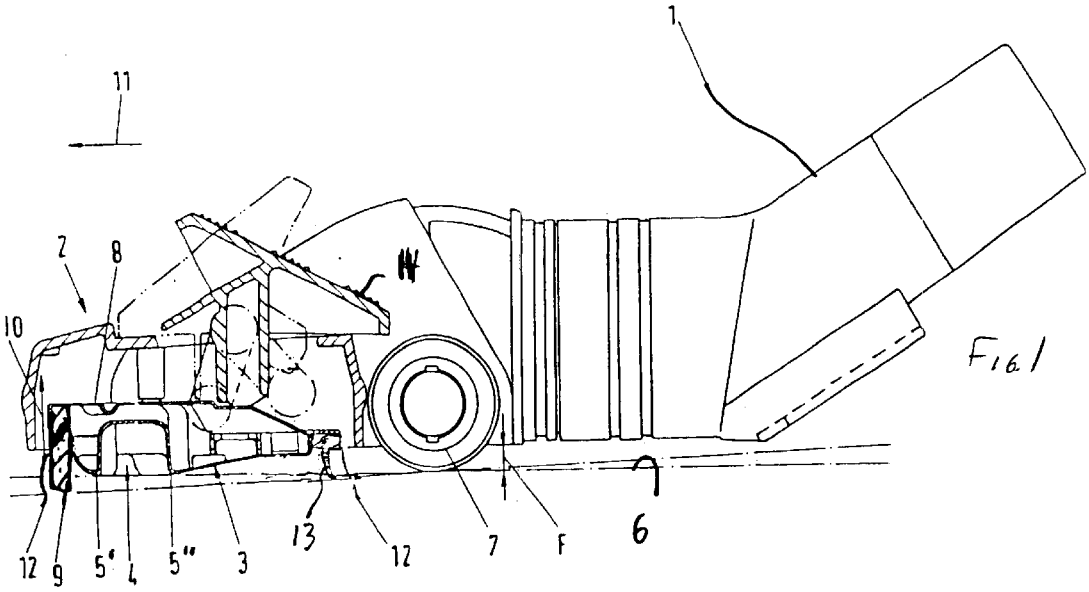
FIG. 1 is a partly diagrammatic vertical section through a floor head according to the invention.

As seen in FIG. 1 a vacuum-cleaner suction tube 1 has a lower end connected to a head 2 having a bottom wall 3 formed with a horizontally elongated and downwardly open mouth 4 defined between front and rear edges 5' and 5". A pair of optional rear wheels 7 pivotal on the head 2 about a horizontal axis parallel to the mouth 4 and somewhat therebehind in a normal advance direction 11 hold the rear end of the head 2 up above a floor surface 6 as the head 2 is pushed in the direction 11.

A frame 8 vertically displaceable in the head 1 by a tippable actuator element 14 carries an annular elastically compressible strip 9 projecting in a direction 10 through a slot 12 in front of the mouth 4 for engagement of the strip 9 with the floor 6. Behind the mouth 4 is a standard non load-bearing rubber strip 13 and in fact the strips 13 and 9 can be joined to be annularly continuous.

Figure 2:
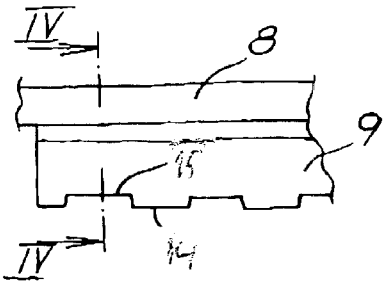
FIG. 2 is a front view of a detail of the invention.

The strip 9 is made as a solid piece of synthetic resin foam formed as shown in FIG. 2 with a profiled lower edge forming ridges 14 alternating with hollows 15. The ridges 14 and hollows 15 extend in the travel direction 11 and are provided at least to the front side of the mouth 4. Thus during vacuuming of a dry floor, small particles will not be pushed by the strip 9 but, instead, will be aspirated through the hollows 15 and up into the mouth 4.

Figure 4:
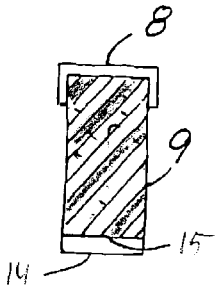
FIG. 4 is a section taken along line IV-IV of FIG. 2.

According to the invention as shown in FIGS. 2 and 4 the material of the strip 9 is sufficiently firm, while remaining elastically deformable, that it can carry the weight of the head 2 and related structure without deforming so much that the bottom plate 3 engages the floor 6, even when air is being sucked up through the mouth 4 so as to pull the head 2 downward. Thus the wheels 7 are not needed when the frame 8 is lowered and the head 2 is supported on the strip 9. For vacuuming carpet, the frame 8 is raised and the sole plate 3 rides directly on the carpet.

Figure 3:
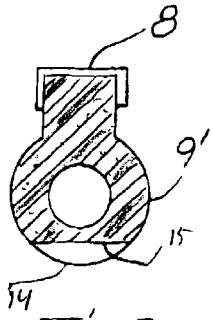
FIG. 3 is a cross section through another seal strip according to the invention.

FIG. 3 shows how a strip 9' can be used that is formed as a plastic tube having the ridges 14 and hollows 15. Such a tubular strip 9' can be made quite strong yet still compressible, and particles will not imbed in its surface.

Figure 5:
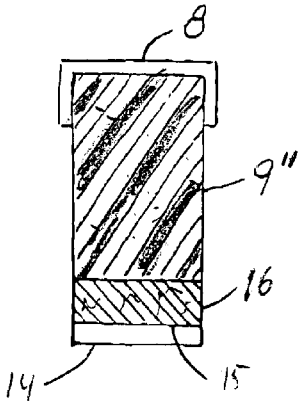
FIG. 5 is a cross section through another floor seal strip in accordance with the invention.

In FIG. 5 the strip 9" is a foam plastic and a layer 16 of a needle felt is provided along its edge to form the ridges 14 and hollows 15. In all cases the strip 9, 9', or 9" is firm enough to carry the weight of the head 2 without deforming sufficiently to let the plate 3 engage the floor 6.

It is also within the scope of this invention to mount the strip so it follows the outer periphery of the head 2, running around the edge of the bottom wall 3.

We claim:

1. A vacuum-cleaner floor head for dry vacuuming of a smooth floor, the head comprising:

a base plate formed with an elongated mouth through which air is aspirated;

a frame vertically displaceable between a lower position and an upper position; and a plastic tube carried on the frame, engaging a floor underneath the head in the lower position, and clear of the floor in the upper position, the plastic tube being annularly continuous and elastomerically compressible, surrounding the mouth, and sufficiently firm to support the head off the floor without substantial deformation during normal back and forth stroking of the head on the floor in the lower position of the frame, the plastic tube having at least to a front side of the mouth a pro-filed lower surface formed with a plurality of alternating ridges and hollows, whereby in the lower position the ridges engage the floor and air can be aspirated through the hollows between the floor and the plastic tube.

2. The vacuum-cleaner floor head defined in claim 1 wherein the plastic tube is straight and extends parallel to the mouth at the front side thereof.

* * * * *